US006279554B1

(12) United States Patent
Sayama et al.

(10) Patent No.: US 6,279,554 B1
(45) Date of Patent: Aug. 28, 2001

(54) ENGINE CRANKCASE VENTILATION SYSTEM INCLUDING A BLOWBY GAS PASSAGE DEFINED BETWEEN CRANKCASE MEMBERS

(75) Inventors: Takehiko Sayama; Kazuhiro Akima; Noriaki Fujii, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/494,141

(22) Filed: Jan. 28, 2000

(30) Foreign Application Priority Data

Feb. 1, 1999 (JP) ..... 11-024106
Feb. 8, 1999 (JP) ..... 11-030417

(51) Int. Cl.[7] ..... F01M 13/00
(52) U.S. Cl. ..... 123/572
(58) Field of Search ..... 123/572, 573, 123/574, 41.86

(56) References Cited

U.S. PATENT DOCUMENTS 4,515,137 * 5/1985 Manolis ..... 123/572
4,947,812 * 8/1990 Inoue et al. ..... 123/572
5,069,192 * 12/1991 Matsumoto et al. ..... 123/572
5,261,380 11/1993 Romano .
5,850,823 * 12/1998 Kasahara ..... 123/572

FOREIGN PATENT DOCUMENTS

19720383A1 11/1998 (DE) .
0291358A2 11/1988 (EP) .
0705964A2 4/1996 (EP) .
2260365A 4/1993 (GB) .
61-135914 6/1986 (JP) .
03182614 8/1991 (JP) .

* cited by examiner

*Primary Examiner*—Marguerite McMahon
(74) *Attorney, Agent, or Firm*—Armstrong, Westerman, Hattori, McLeland & Naughton, LLP

(57) ABSTRACT

In an engine crankcase ventilation system, a blowby gas passage and a fresh air passage are defined between adjoining crankcase members so as to extend in parallel with a crankshaft axial line along either side of a lower part of said crankcase assembly. Because the crankcase is configured to receive the rotating crankshaft provided with counterweights, it necessarily has a circular cross section. Therefore, this arrangement allows effective utilization of the available space. Thus, a cavity of a required volume for effective oil separation and pressure pulsation damping can be formed in the engine main body without increasing the number of components parts, and without complicating or increasing the size of the overall structure.

23 Claims, 13 Drawing Sheets

E
1
2
3
3a
3b
4
5
6
7
8
9
10
11
12
13
14
15
16a
16b
17
18
19
20a
20b
21
22
23
23a
F1
F2
F3

ENGINE CRANKCASE VENTILATION SYSTEM INCLUDING A BLOWBY GAS PASSAGE DEFINED BETWEEN CRANKCASE MEMBERS

TECHNICAL FIELD

The present invention relates to an engine crankcase ventilation system, and in particular to an engine crankcase ventilation system which allows a relatively large oil separation chamber or passage to be defined without increasing the size of the engine.

BACKGROUND OF THE INVENTION

Typically, a crankcase ventilation passage opens into the crankcase of an engine for recycling the blowby gas, which has passed through the gap between the pistons and cylinders, to the intake system, and to control the pressure pulsation due to the reciprocating motion of the pistons (see Japanese patent laid-open publication No. 61-135914).

The crankcase is filled with lubrication oil mist, and a certain amount of the oil mist inevitably enters the ventilation passage. However, an excessive introduction of oil into the blowby gas is not desirable because it adversely affects the quality of the exhaust gas and contributes to an increase in oil consumption. To avoid such an inconvenience, it has been proposed, for instance, in Japanese patent laid open publication No. 61-135914 to provide an oil separation chamber between the two cylinder banks of a V-engine.

However, to achieve an adequate capability to separate oil, the oil separation chamber is required to have a certain volume, and the provision of such an oil separation chamber in the engine results in an increase in the number of components parts, and the complication and size increase of the overall structure.

The blowby gas removed from the crankcase must be replaced by fresh air from the atmosphere. The pressure pulsation in the crankcase can be transmitted from a fresh air passage for introducing fresh air into the crankcase. Also, it is possible for the blowby gas to flow backward under special circumstances. To address these problems, it is therefore desirable to provide a relatively large passage or chamber for fresh air for both effective noise muffling and oil separation. However, it prevents a compact design of the engine.

The blowby gas is typically passed through a passage which is adapted to remove oil mist therefrom, and is then forwarded to the downstream of a throttle valve so that hydrocarbon that may be contained in the blowby gas may be recycled to the engine intake to improve fuel efficiency and reduce engine emissions. Therefore, a passage must be defined between the crankcase typically provided in a lower part of the engine and the intake system which is typically provided in an upper part of the engine, and the need for such a passage tends to complicate the structure of the engine. Typically, rubber hoses are used for conducting blowby gas from the crankcase to the intake system.

BRIEF SUMMARY OF THE INVENTION

In view of such problems of the prior art, a primary object of the present invention is to provide an engine crankcase ventilation system which allows a relatively large blowby gas passage to be defined without increasing the size of the engine or increasing the number of component parts.

A second object of the present invention is to provide an engine crankcase ventilation system which is provided with a relatively large fresh air passage as well as a relatively large blowby gas passage without increasing the size of the engine.

A third object of the present invention is to provide an engine crankcase ventilation system which is compact in size and effective in removing oil from the blowby gas.

According to the present invention, such objects can be accomplished by providing an engine crankcase ventilation system for an internal combustion engine including a plurality of crankcase members jointly defining a crankcase assembly, comprising: a blowby gas passage and a fresh air passage which are defined between adjoining crankcase members independently from each other. Thus, removal of blowby gas and introduction of fresh air can be accomplished in an efficient manner.

Preferably, the blowby gas passage extends in parallel with a crankshaft axial line along a first side of a lower part of the crankcase assembly; and the fresh air passage extends in parallel with a crankshaft axial line along a second side of a lower part of the crankcase assembly.

Because the crankcase is configured to receive the rotating crankshaft provided with counterweights, it necessarily has a circular cross section. Therefore, by defining the blowby gas passage and the fresh air passage along either side of the lower part of the crankcase assembly, it is possible to effectively utilize the available space. Thus, a cavity of a required volume for effective oil separation and pressure pulsation damping can be formed in the engine main body without increasing the number of components parts, and without complicating or increasing the size of the overall structure.

To effectively remove oil from the blowby gas passage, it is desirable to reduce the flow velocity of the blowby gas. To this end, it is advantageous to ensure a relatively large volume for the blowby gas passage. For the same reason, the blowby gas passage is preferably provided with a middle part which is enlarged as compared with an inlet end thereof so as to define an expansion chamber. Also, providing baffle plates in the blowby gas passage so as to define a tortuous passage contributes to effective removal of oil from the blowby gas.

Similar arrangements for the fresh air passage are advantageous for muffling low frequency engine noise, and effective removal of oil in case of a backflow of blowby gas.

To maximize the effective volume of the blowby gas passage, the blowby gas passage may be defined by a cylinder block lower case and an oil pan upper member, and communicates with a space above oil received in an oil pan via an opening provided in an axial end of the blowby gas passage. According to a particularly preferred embodiment of the present invention, the opening in the axial end of the blowby gas passage is provided in a recess in an axial end of the crankcase assembly, and an opening communicating with the space above the oil is provided also within the recess, a communication passage being defined between these two openings by a cover plate placed over the recess. This arrangement provides an inlet to the blowby gas passage at an axial end thereof without complicating the fabrication process therefor. Similar arrangement may be used for the fresh air passage.

The exit end of the blowby gas passage may be provided at the opposite axial end thereof. In this case, the blowby gas passage communicates with a downstream of a throttle valve via an exit end of the blowby gas passage defined by an opening formed in a recess provided in the opposite axial end of the crankcase assembly, and a communication passage defined between the recess and a cover plate placed over the recess.

When the internal combustion engine consists of a multiple-cylinder V-engine, and an intake system is placed between two cylinder banks of the V-engine, the communication passage may be arranged so as to communicate with the downstream of the throttle body via a first passage defined in an upper middle part of the crankcase assembly in parallel with the crankshaft axial line, and a second passage defined along a side of the cylinder bank and extending perpendicularly from a middle part of the first passage along a cylinder axial line.

To simplify the communication between the blowby gas passage and the intake system, passages may be defined in the cylinder head and the intake system in such a manner that the cylinder head passage and the intake system passage communicate with each other via opposing openings in mating surfaces of the cylinder head and the intake system.

To form the second passage while allowing the intake system to be placed close to a side of a cylinder bank so as make optimum use of the available space, the second passage may defined in a ridge formed in a corresponding part of the cylinder bank while the intake system is provided with a recess for receiving the ridge.

These arrangements for the blowby gas passage are equally applicable to the fresh air passage for similar advantages. It is desirable to ventilate the cam chamber in the cylinder head. To this end, the first passage for fresh air may communicate with a cam chamber defined above the cylinder head via a third passage defined along a side of the cylinder bank and extending perpendicularly from the first passage along a cylinder axial line.

BRIEF DESCRIPTION OF THE DRAWINGS

Now the present invention is described in the following with reference to the appended drawings, in which.

DETAILED DESCRIPTION OF THE PREFERRED OF THE EMBODIMENTS

Figure 1:
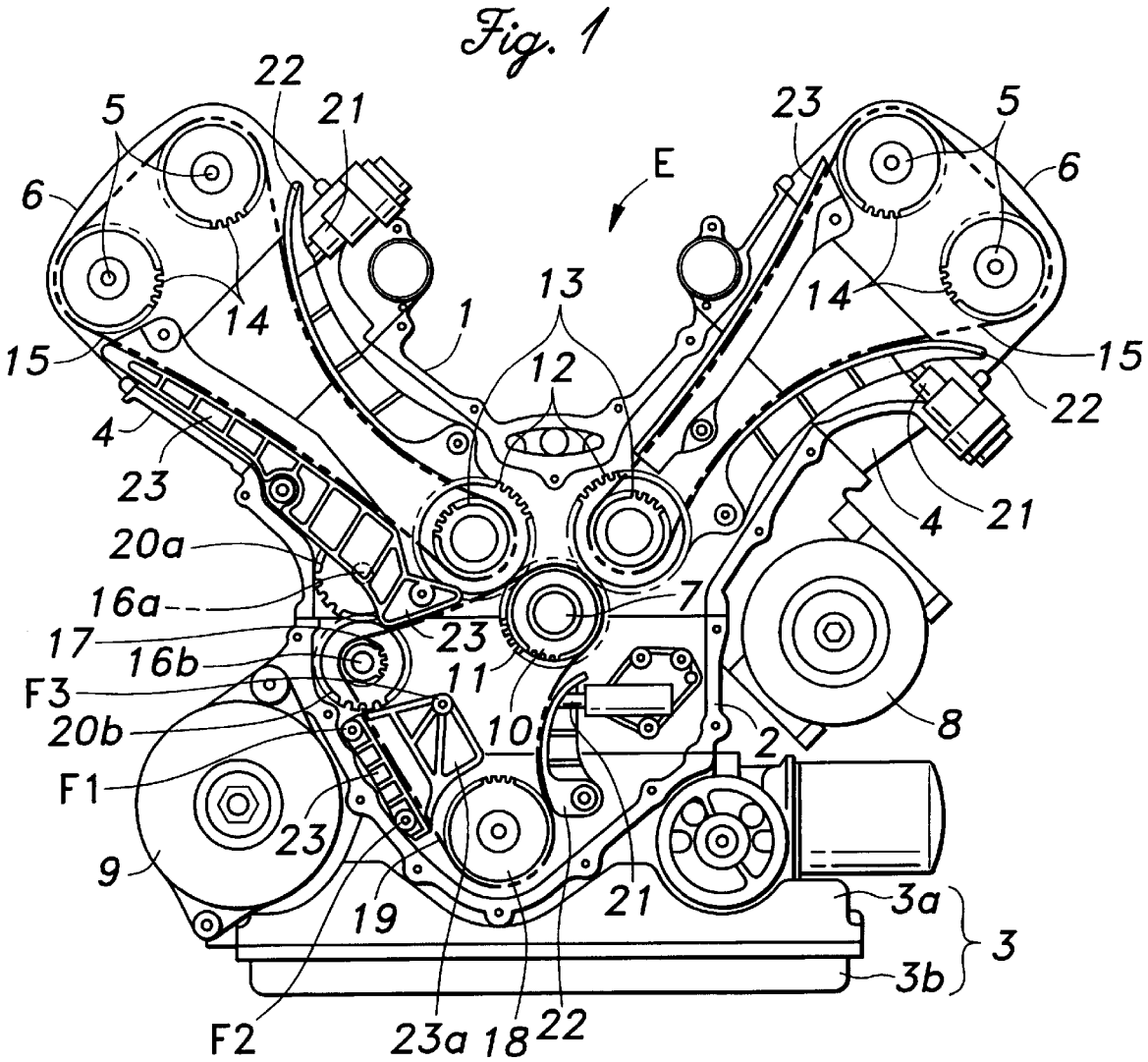
FIG. 1 is a front view of the crank pulley end of a V-engine embodying the present invention.

FIG. 1 is a front view showing a crank pulley end of a four-stroke, eight-cylinder V engine embodying the present invention. In FIG. 1, the intake system which is described later in this description is omitted for the clarity of illustration.

This engine E comprises an upper block 1 having a V-shape so as to define a 90 angle between axial lines of cylinder banks B, a lower block 2 attached to a lower surface of the upper block 1, an oil pan 3 attached to a lower surface of the lower block 2, and a cylinder head 4 attached to the upper surface of each cylinder bank B of the upper block 1. In this embodiment, the oil pan 3 comprises an upper member 3*a* made of a die cast aluminum alloy, and a lower member 3*b* made of stamped steel plate, and these two parts are attached to each other by a number of threaded bolts. A pair of camshafts 5 are disposed above each of the cylinder heads 4. These camshafts 5 are covered by a head cover 6 attached to the upper surface of the corresponding cylinder head 4. A crankshaft 7 is supported in the interface between the upper block 1 and the lower block 2 via a main bearing.

A compressor 8 for an air conditioner is attached to a part of the upper block 1 on one side of the crankshaft 7 (to the right in FIG. 1), and an AC generator 9 is attached to a part of the lower block 2 on the other side of the crankshaft 7 (to the left in FIG. 1). The compressor 8 and the AC generator 9 are driveably connected to the crankshaft 7 via a belt and pulley mechanism not shown in the drawing.

A crank sprocket 10 is fitted on a part of the crankshaft 7 somewhat inward from the crank pulley, and a drive pinion 11 is fitted on a part of the crankshaft 7 which is even more inward.

The drive pinion 11 meshes with a pair of driven pinions 12 which are disposed at symmetric positions with respect to a plane which bisects the angle between the two cylinder banks B and passes through the axial center of the crankshaft 7. Each of these driven pinions 12 is integrally provided with a small sprocket 13, and a silent chain 15 is passed around each of the small sprockets 13 and cam sprockets 14 fitted on the associated pair of camshafts 5 to actuate the cams. Thus, the rotational power of the crankshaft 7 is transmitted to the two camshafts 5 provided on each of the cylinder heads 4.

The upper block 1 and the lower block 2 are separated from each other by a horizontal plane through which the axial center of the crankshaft 7 passes, and a pair of balancer shafts 16*a* and 16*b* are rotatably supported at symmetric positions with respect this horizontal plane with their axial lines extending in parallel with the axial line of the crankshaft 7.

One of the balancer shafts 16*b* which is supported on the side of the lower block 2 is fitted with a balancer shaft sprocket 17 at an axial end thereof. A silent chain 19 is passed around this balancer shaft sprocket 17, the crank sprocket 10, and a pump sprocket 18 attached to an oil pump (not shown in the drawing) which is in turn mounted to the lower surface of the lower block 2 so that the lower balancer shaft 16*b* and the oil pump may be actuated by the crankshaft 7.

The two balancer shafts 16*a* and 16*b* rotate at the same speed (twice the rotational speed of the crankshaft) but in the opposite directions due to the meshing between gears 20*a* and 20*b* having a same number of teeth and fitted on the corresponding balancer shafts 16*a* and 16*b* behind the sprocket 17. This arrangement is adapted to cancel the horizontal component of the unbalance inertia force due to the motion of the pistons in the V-shaped cylinder banks.

The silent chains 15 passed around the cam sprockets 14 of the corresponding camshafts 5, as well as the silent chain 19 passed around the balancer shafts sprockets 17 and the pump sprocket 18, are each provided with a chain tensioner 22 for automatically adjusting pressure application on the chain by using a hydraulic plunger 21, and a chain guide 23 for restricting lateral motion of the chain. The chain tensioner 22 and the chain guide 23 are attached to the crank pulley side end surface of the upper block 1, lower block 2, oil pan 3 and cylinder heads 4 by using threaded bolts. The crank pulley end of the engine E is substantially entirely covered by a chain cover (not shown in the drawing).

Figure 2:
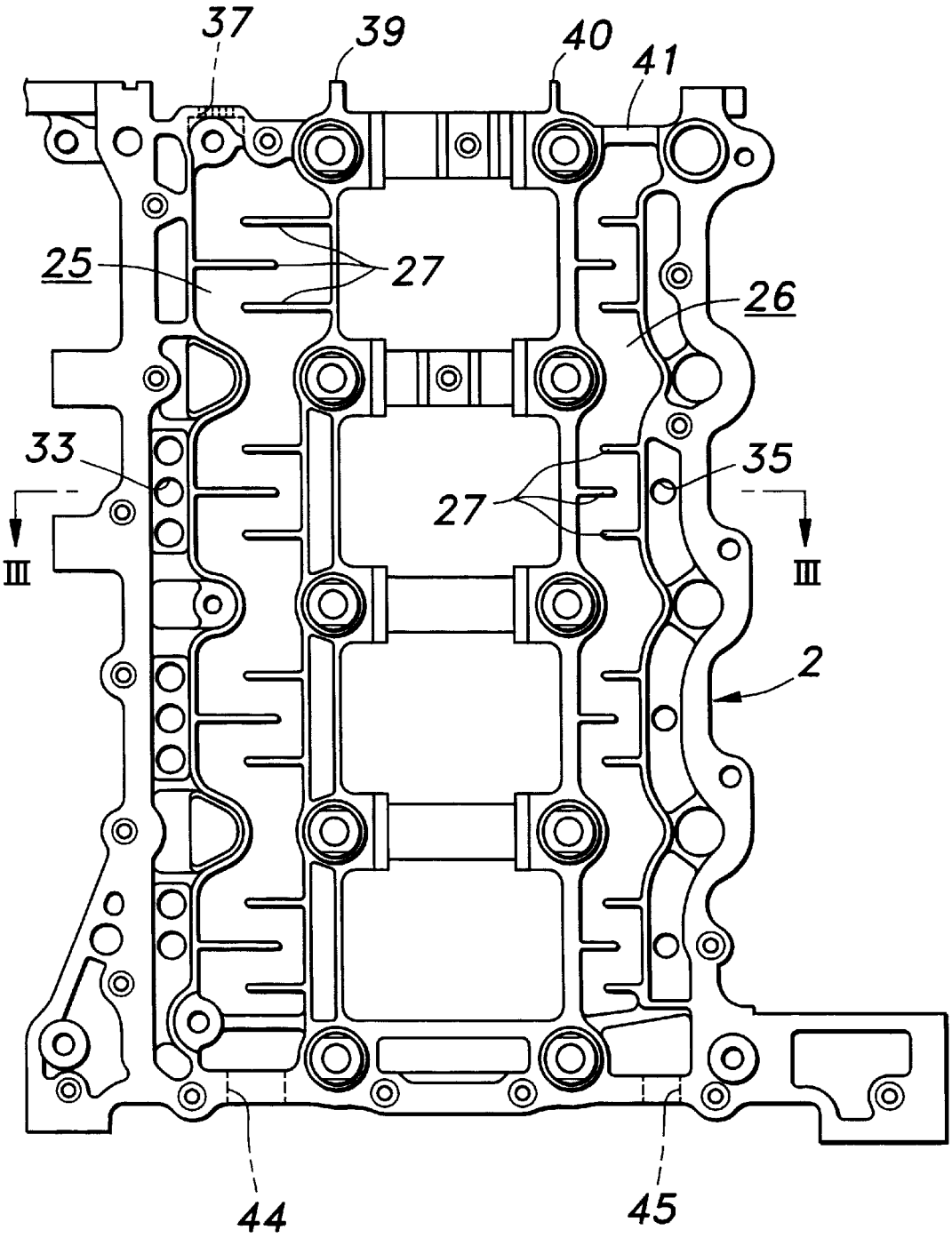
FIG. 2 is a bottom view of the lower block of the engine illustrated in FIG. 1 which is adapted to be joined to an oil pan upper member.
Figure 3:
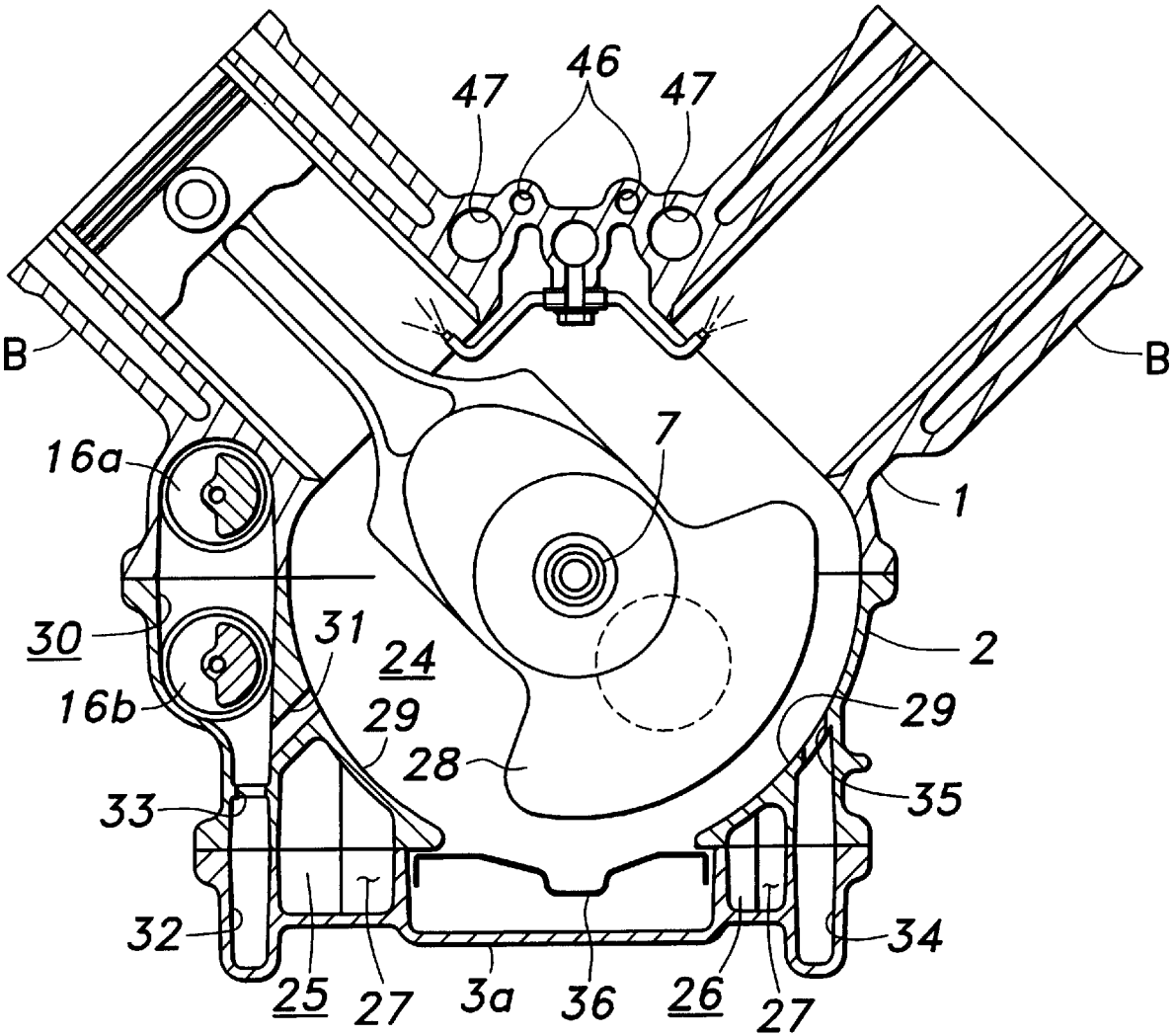
FIG. 3 is a sectional view taken along line III—III of FIG. 1.

Referring to FIGS. 2 and 3, a blowby gas chamber 25 for removing oil from the blowby gas which is recycled from the crankcase 24 to the intake system is provided on the right side of the interface between the lower block 2 and the oil pan 3 as seen in FIG. 1. A fresh air chamber 26 for admitting fresh air from the intake system into the crankcase 24 is provided on the left side of this interface.

The two chambers 25 and 26 each open out at the two axial end surfaces of the lower block 2. The chamber 25 and 26 each have a generally larger cross section than the openings at its axial ends, and define a tortuous passage by virtue of a plurality of ribs 27 projecting perpendicularly with respect to the flow line or the axial line of the crankshaft 7 from either side wall in an alternating fashion. These ribs 27 not only enhance the oil separating capability by defining a tortuous passage but also are effective in avoiding the reduction in the rigidity due to the creation of such large cavities.

The upper walls of the two chambers 25 and 26 are defined by baffle walls 29 which correspond to the rotational trajectory of the counterweights 28 formed integrally with the crankshaft 7, and separate the crankcase 24 defined in the upper and lower blocks 1 and 2 from the oil pan 3. The blowby gas chamber 25 partly overlaps with a balancer shaft chamber 30, defined on the left side of the crankcase 24, as seen from a side. In other words, the blowby gas chamber 25 is defined between the baffle 29 and the balancer shaft 30 as seen from the axial end of the crankshaft 7. Thereby, an available space is not wasted, and an oil separation chamber having a relatively large volume can be formed without increasing the overall size of the engine.

The fresh air chamber 26 is normally free from any oil because it constantly receives a supply of fresh air, but is provided with a tortuous passage in view of a possibility of the blowby gas flowing backward.

The part of the inner surface of the left side wall of the lower block 2, as seen in FIG. 3, on which the baffle 29 is placed, is provided with a slanted passage 31 which slants downward toward the bottom of the balancer shaft chamber 30. The balancer shaft chamber 30 opens out to the left oil passage 32 formed in the interface between the lower block 2 and the oil pan 3 via a vertical passage 33 appropriately formed in the bottom wall of the balancer shaft chamber 30.

A cast hole 35 is provided in the part of the baffle 29 adjoining the right inner side wall of the lower block 2 as seen in FIG. 3, and this cast hole 35 communicates with a right oil passage 34 which is formed in the interface between the lower block 2 and the oil pan 3. The lower part of the crankcase is defined by a plate member 36 made of stamped steel plate extending along the trajectory of the counterweight 28. The oil in the crankcase which is thrown up by the counter weights 28 of the crankshaft 7 can thus return to the oil pan 3 in a short time via the passages 31 to 35. The plate member prevents the motion of the crankshaft 7 or the wind pressure caused by this motion from disturbing the surface of the lubiricating oil received in the oil pan 3.

Figure 4:
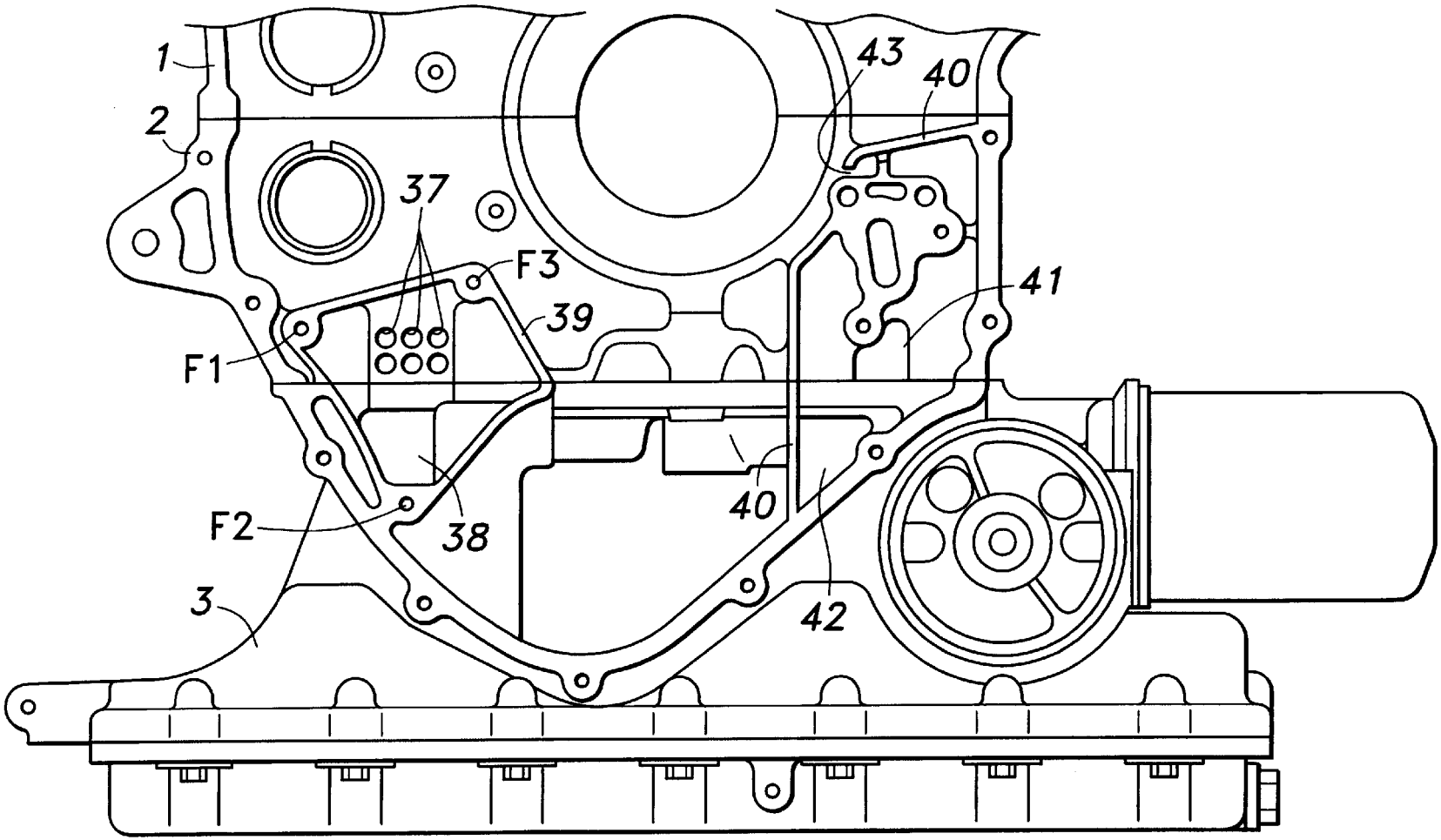
FIG. 4 is a fragmentary front view of the crank pulley end of the V-engine shown in FIG. 1.
Figure 5:
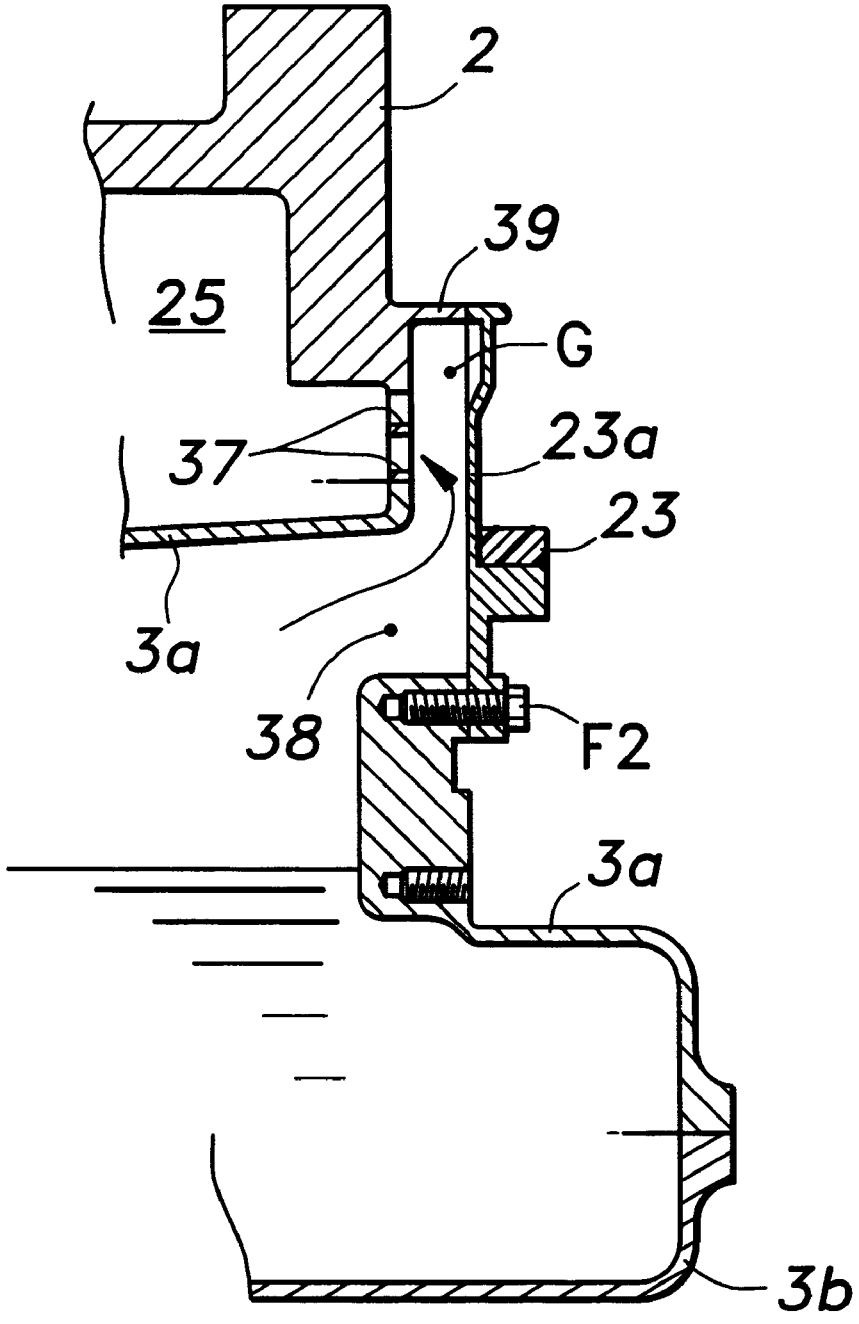
FIG. 5 is a sectional view of an essential part taken along line V—V of FIG. 4.

Referring to FIGS. 4 and 5, the opening of the blowby gas chamber 25 on the end surface of the lower block 2 on the side of the crank pulley consists of a plurality of small holes 37 which communicate with the space above the oil surface in the oil pan 3 via a hole 38 formed in the end wall of the oil pan 3. This area, which is provided with the small holes 37 and the hole 38, is surrounded by a rib 39, and is closed, at its front end, by a support base 23*a* of the chain guide 23 with the support base being attached to the free end of the rib 39 between the balancer shaft sprocket 17 and the pump sprocket 18.

The blowby gas containing oil mist thus flows into the blowby gas chamber 25 from the gap G between the inner surface of the support base 23*a* of the chain guide 23 and the front surface of the lower block 2 via the small holes 37 (see the arrow in FIG. 5). The oil mist is separated also as the blowby gas passes through this gap G and the small holes 37.

The chain guide 23 is attached to the lower block 2 and the oil pan 3 at its lower and upper ends by a first fastening portion F1 and a second fastening portion F2, respectively, and the support base 23*a* is additionally attached by a third fastening portion F3.

The part of the end wall on the side of the crank pulley surrounding the fresh air chamber 26 is likewise provided with a rib 40. In this case, the rib 40 cooperates with the rib provided on the inner surface of a chain cover not shown in the drawing so as to define a passage between a hole 41 in the end wall of the lower block 2 and a hole 42 in the end wall of the oil pan 3. The rib 40 is provided with a notch 43 to permit fresh air to be introduced into the interior of the chain cover.

Figure 6:
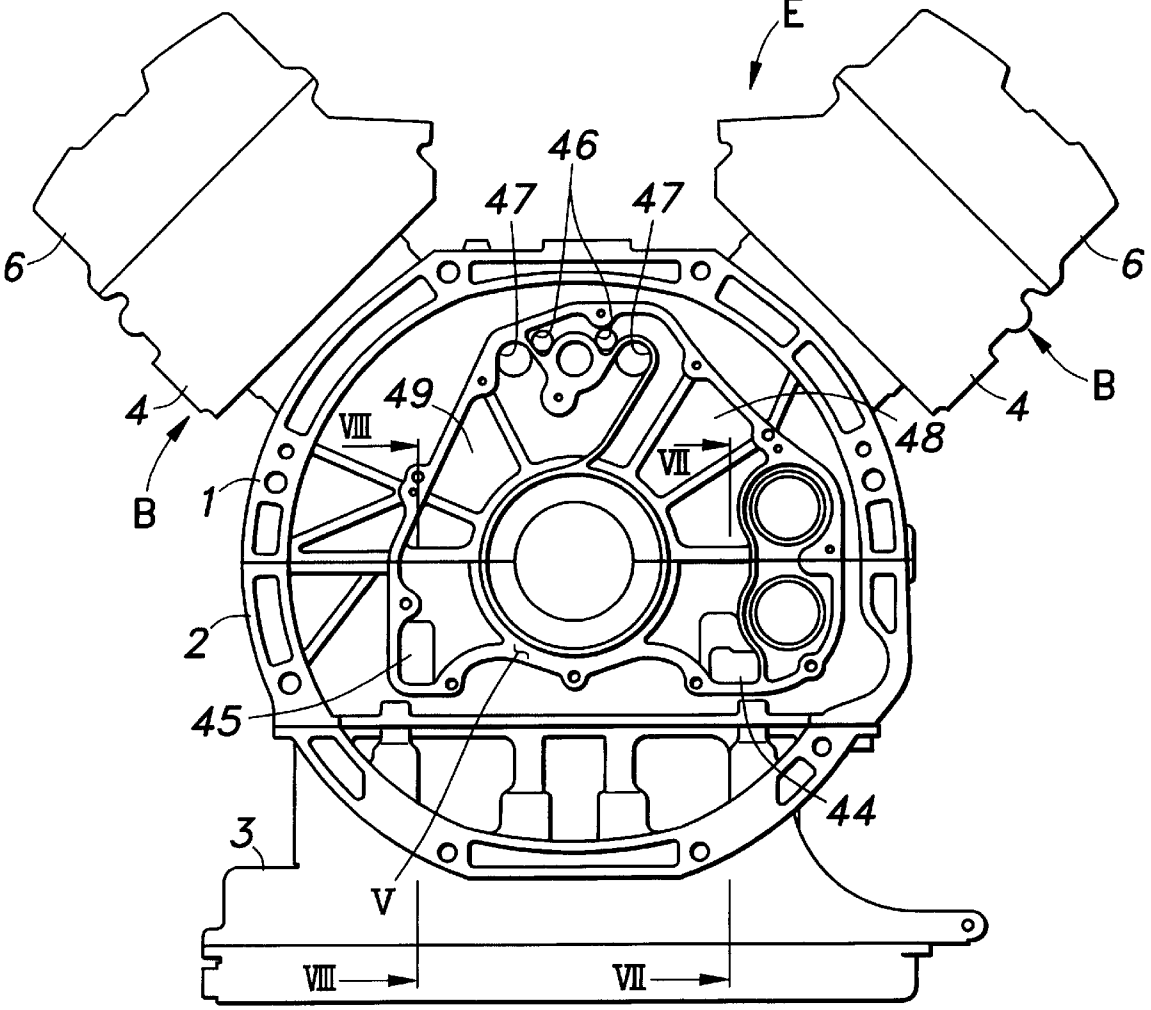
FIG. 6 is a fragmentary view of the transmission end of the V-engine shown in FIG. 1.
Figure 7:
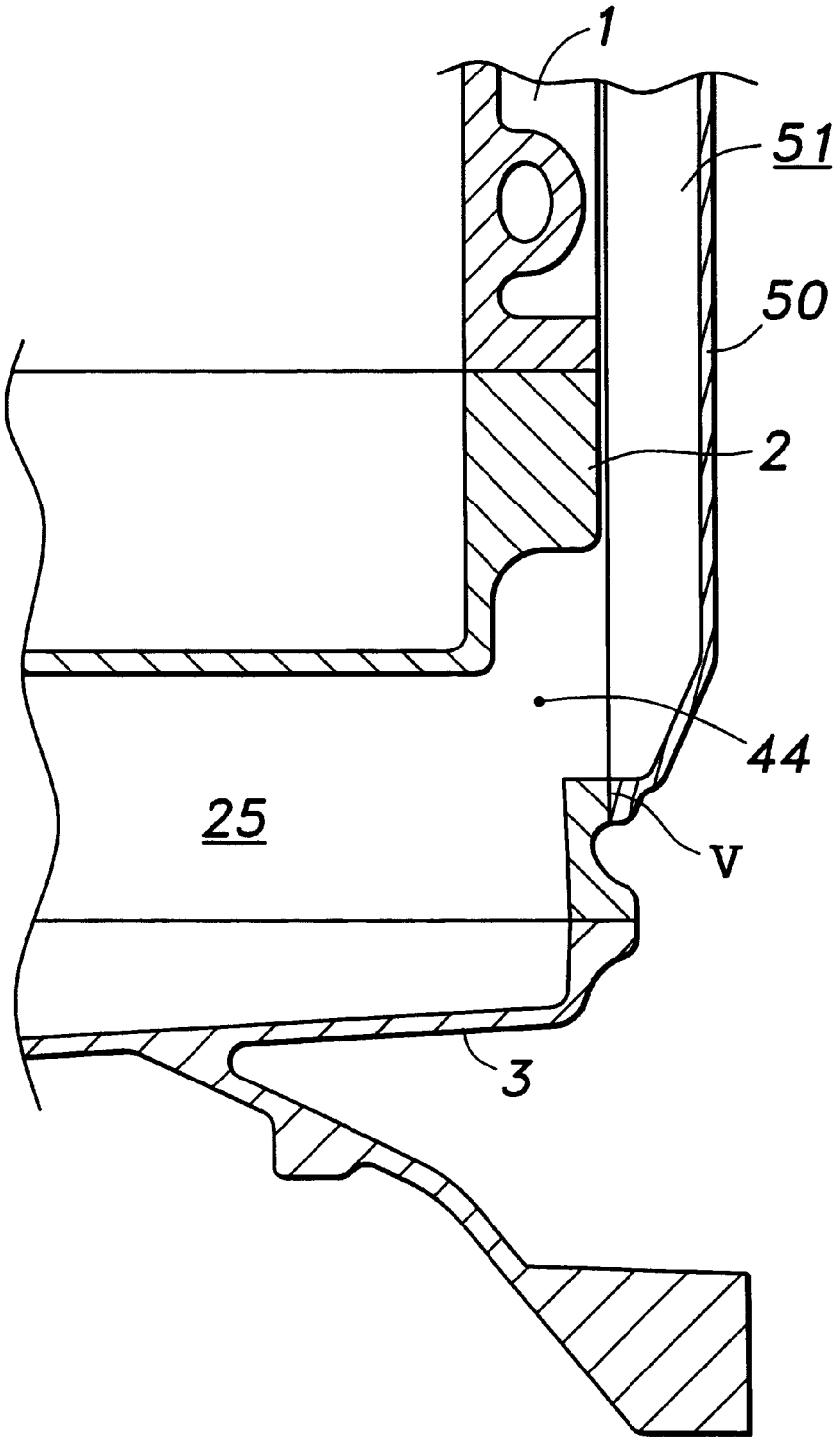
FIG. 7 is a sectional view of an essential part taken along line VII—VII of FIG. 6.
Figure 8:
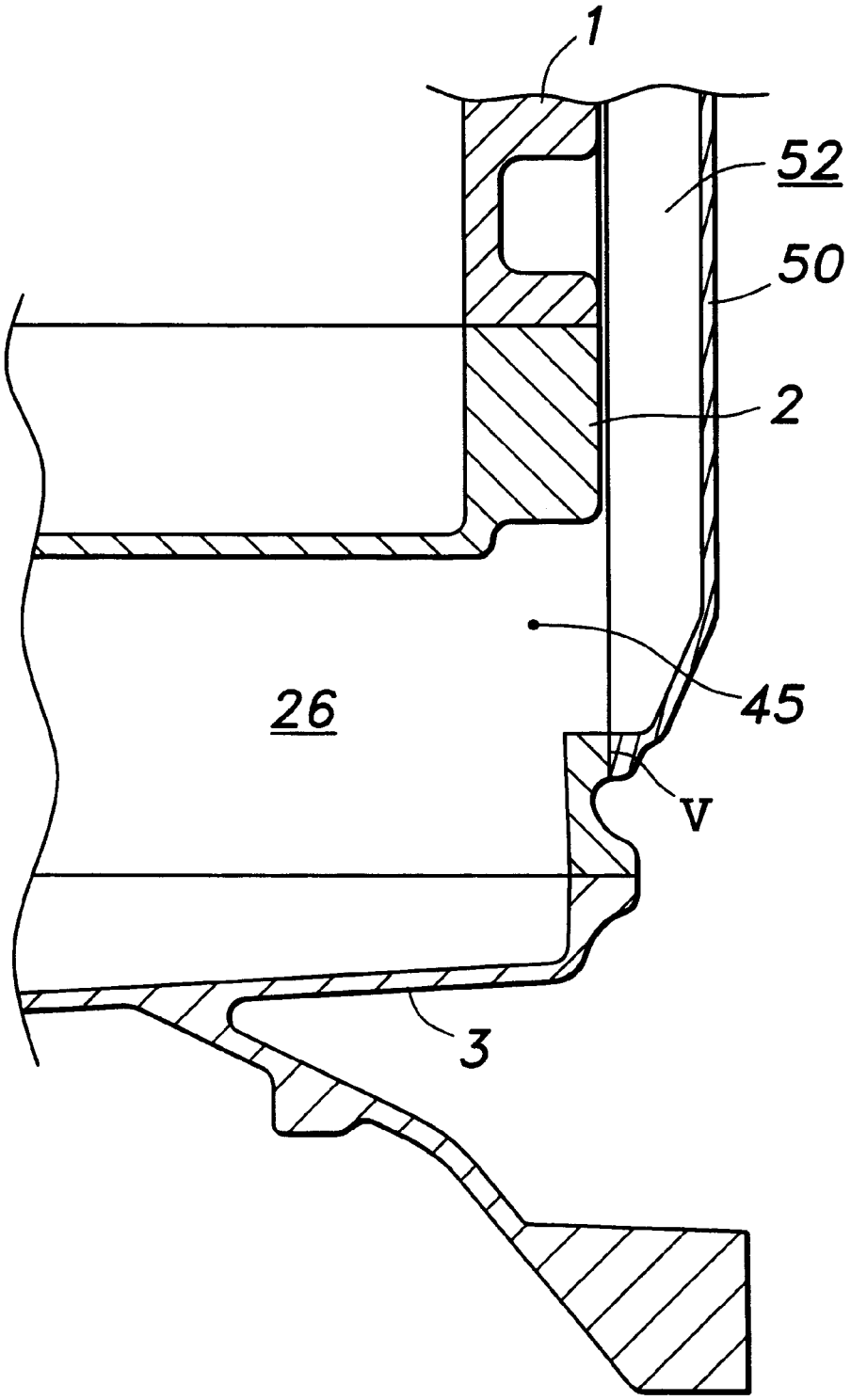
FIG. 8 is a sectional view of an essential part taken along line VIII—VIII of FIG. 6.

On the end wall of the upper and lower blocks 1 and 2 facing the transmission device open out a hole 44 on the other end of the blowby gas chamber 25 and a hole 45 on the other end of the fresh air chamber 26 as shown in FIG. 6. The end wall is additionally provided with recesses 48 and 49 for communicating a pair of blowby gas passages 46 and a pair of fresh air passages 47 provided in the upper block 1 at the bottom of the valley between the two cylinder banks B with the holes 44 and 45 on the other ends of the two chambers 25 and 26, respectively. By attaching an end plate 50 over the vertical surface V surrounding these recesses 48 and 49, communication passages 51 and 52 are defined which individually communicate with the blowby gas chamber 25 and the fresh air chamber 26, respectively (see FIGS. 7 and 8). These passages 51 and 52 may be formed as tortuous passages by providing ribs extending perpendicularly with respect to the flow line in an alternating fashion in a similar way as with the blowby gas chamber 25 and the fresh air chamber 26 so as to achieve a capability to separate oil from the blowby gas although it is not shown in the drawings.

Figure 9:
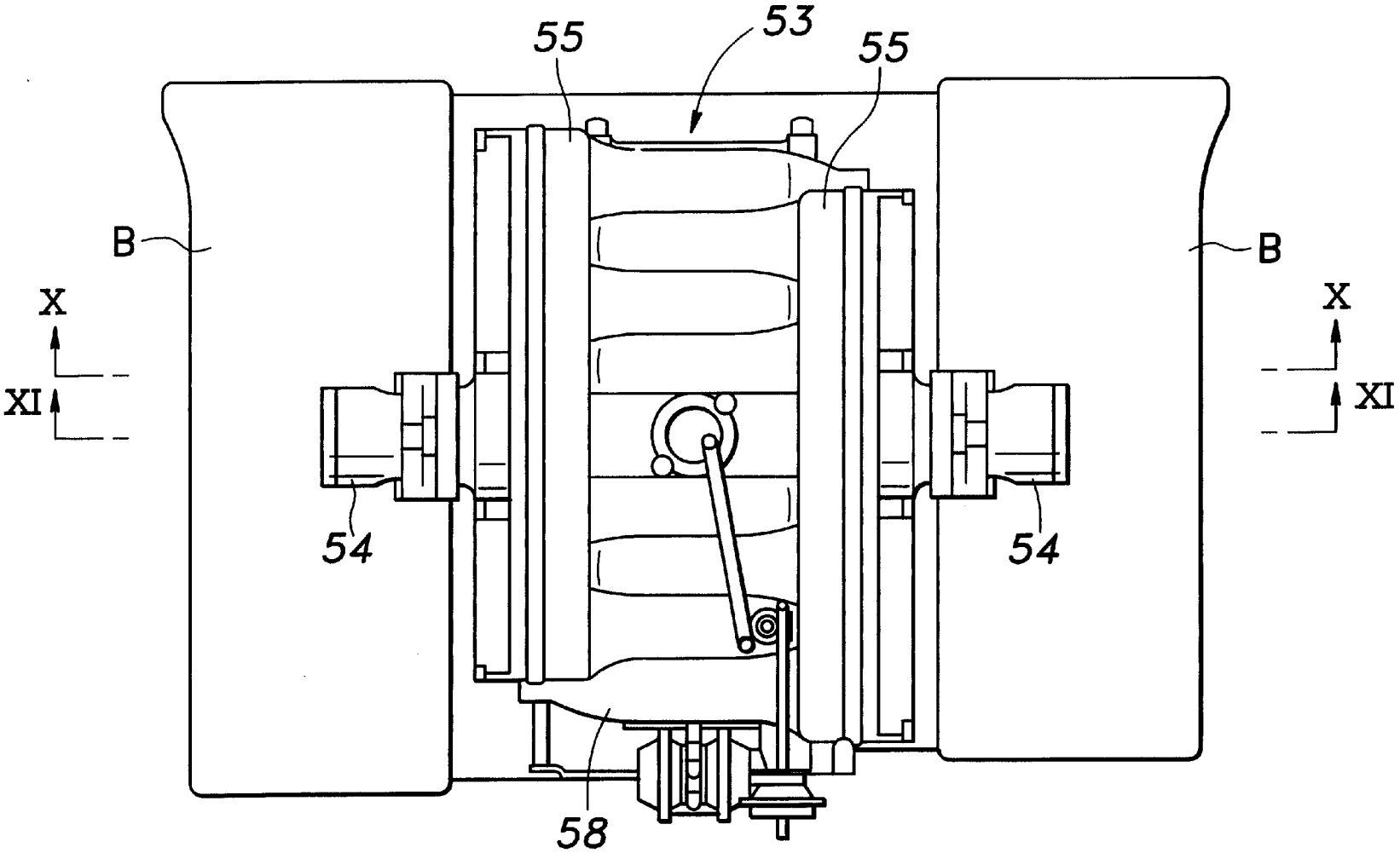
FIG. 9 is a plan view of the engine shown in FIG. 1 along with the associated intake system.
Figure 10:
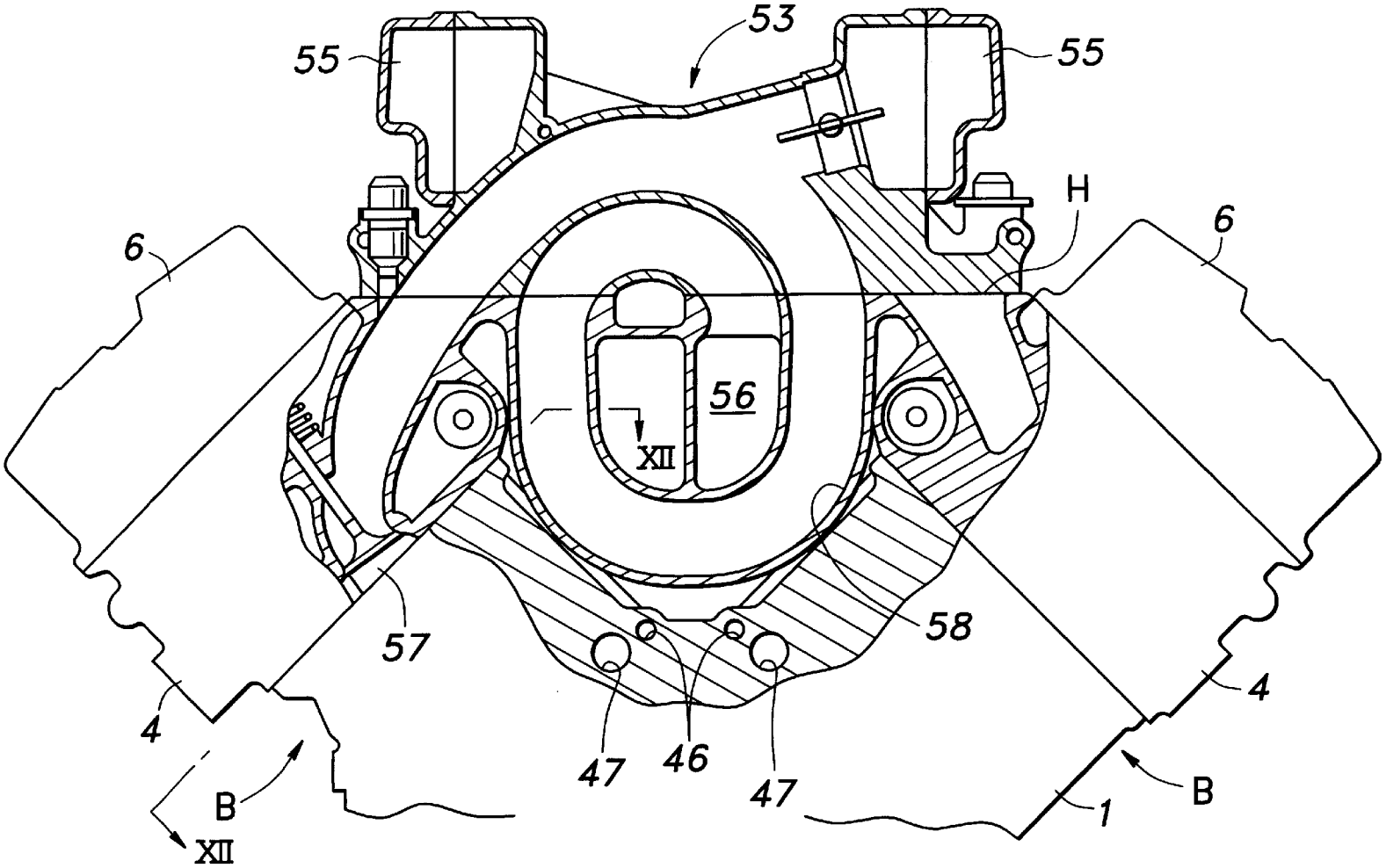
FIG. 10 is a fragmentary sectional view of an essential part taken along line X—X of FIG. 9.
Figure 11:
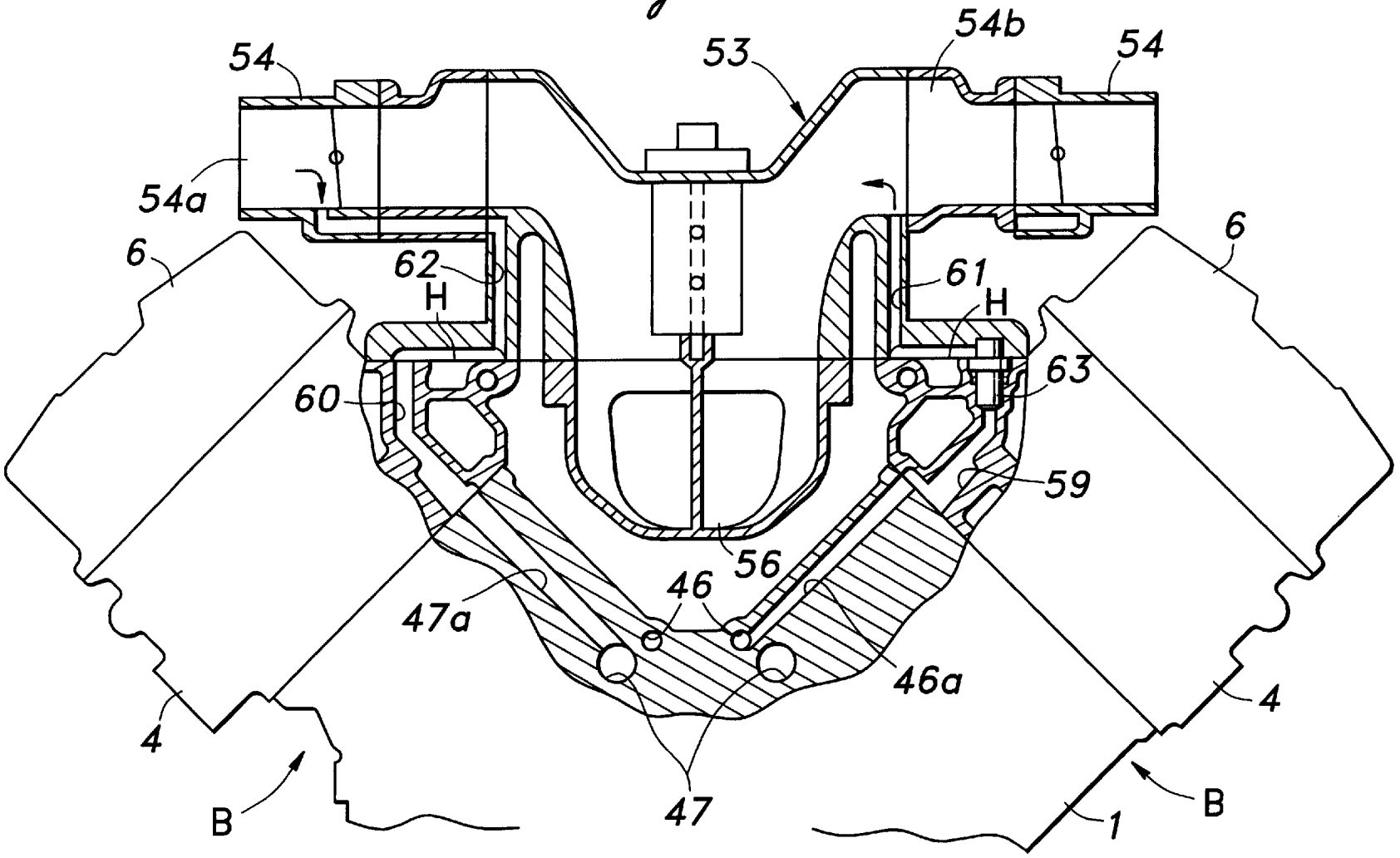
FIG. 11 is a fragmentary sectional view of an essential part taken along line XI—XI of FIG. 9.

Between the two cylinder banks B is provided an intake manifold assembly 53 at a symmetric position bisecting the cylinder axial lines as best shown in FIGS. 9 to 11. The intake manifold assembly 53 comprises a pair of throttle bodies 54 which are located at intermediate points along the crankshaft axial line with the axial line of their inlet ports extending perpendicularly to the axial line of the crankshaft 7, a pair of surge tanks 55 which are elongated along the crankshaft axial line and associated with the respective throttle bodies 54, an intake chamber 56 extending in the crankshaft axial line between the two cylinder banks of the upper block 1, and eight intake pipes 58 extend from the upper surface of the intake chamber 56 to the intake ports 57 of the corresponding cylinders in a spiral manner. The intake manifold 53 is itself attached to a horizontal plane H defined in the cylinder heads 4 between the two cylinder banks. In the case of the engine of this embodiment, it is possible to select one of two possible modes depending on the load condition of the engine so that the intake to the intake ports 57 of the respective cylinders may be passed either directly through the surge tank 55 or via the intake chambers 56 and the spiral intake pipes 58.

Each of the cylinder heads 4 is provided with passages 59 and 60 which are respectively connected to parts 46*a* and 47*a* of the corresponding blowby gas passage 46 and fresh air passage 47 extending along the cylinder axial line, the blowby gas passage 46 and fresh air passage 47 being defined inside the upper block 1. The intake manifold assembly 53 is provided with passages 61 and 62 which are connected to the passages 57 and 58 of the upper block 1. Thus, fresh air is drawn from the upstream 54*a* of the throttle valve of the throttle body 54, and blowby gas is forwarded to the downstream 54*b* of the throttle valve of the throttle body. In other words, the blowby gas passages and the fresh air passages are partly defined in the cylinder head 4, the upper block 1 and the intake manifold 53, and the parts 59 and 60 of the passages formed in the cylinder head 4 directly communicate with the corresponding parts 61 and 62 of the passages formed in the intake manifold 53 at the interface (the horizontal plate H) between the cylinder head 4 and the intake manifold 53.

The PCV valve 63 is firmly held in the interface between the cylinder head 4 and the intake manifold assembly 53 (the opening of the blowby gas passage 59 of the cylinder head 4 facing the intake manifold 53), and would not inadvertently dislodge therefrom.

As discussed above, the throttle bodies 54 are located in a middle part along the crankshaft axial line of the intake manifold 53, and the blowby gas passage 61 communicating with the downstream 54*b* of the throttle valve, as well as the fresh air passage communicating with the upstream 54*a* of the throttle valve, is located in a middle part along the crankshaft axial line of the cylinder head 4. As a result, the length of the passage communicating the intake manifold 53 (intake system) with the passages 46*a* and 47*a* internally provided in a middle part of the upper block 1 along the crankshaft axial line can be minimized, and this contributes to the improvement of the efficiency of ventilation.

Figure 12:
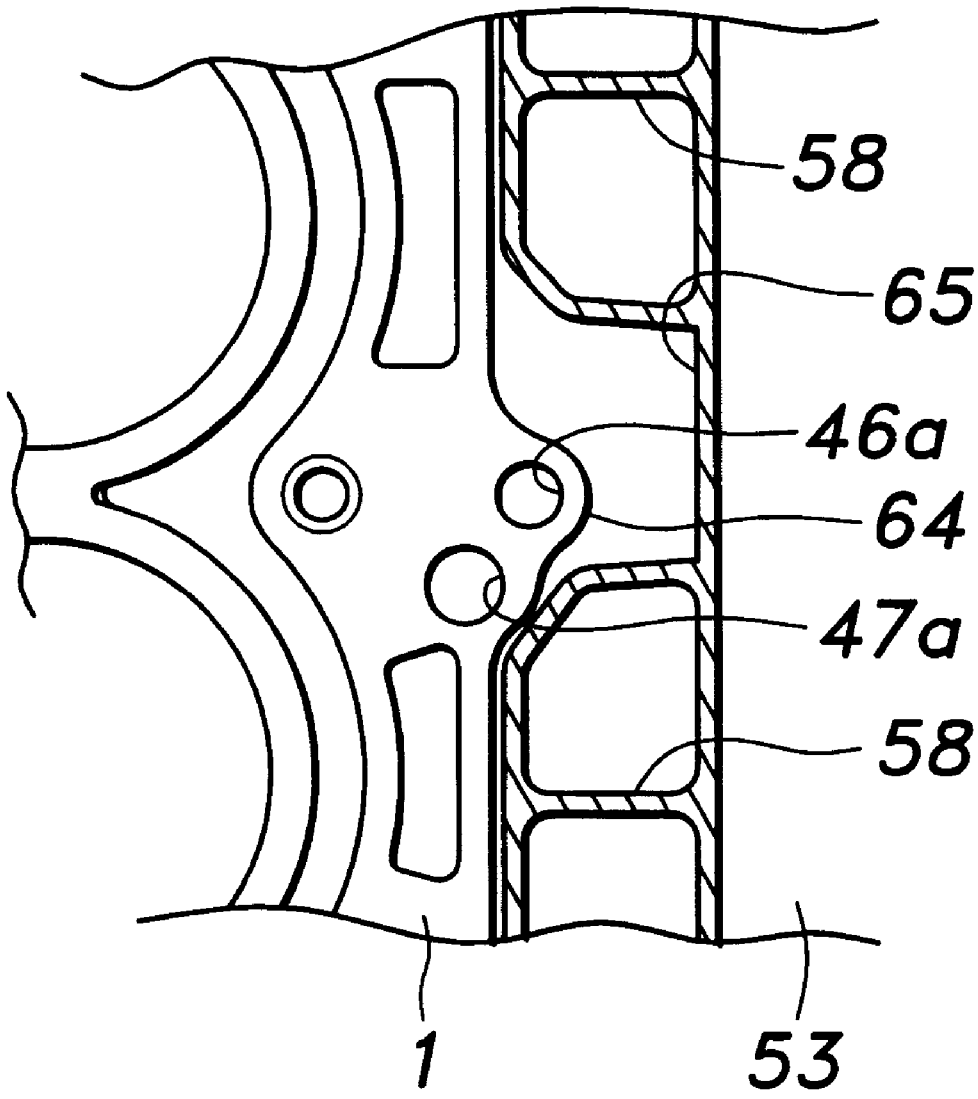
FIG. 12 is a fragmentary sectional view of an essential part taken along line XII—XII of FIG. 10.

The surface of the upper block 1 facing the intake manifold 53 is formed with a ridge 64 on each cylinder bank which is internally provided with a blowby gas passage 46*a* and a fresh air passage 47*a*. The intake manifold 53 is provided with a recess 65 corresponding to the ridge 64 between a pair of adjacent intake pipes 58 (see FIG. 12). As a result, the intake manifold 53 can be placed immediately adjacent to the upper block 1, and this contributes to the compact design of the engine.

Figure 13:
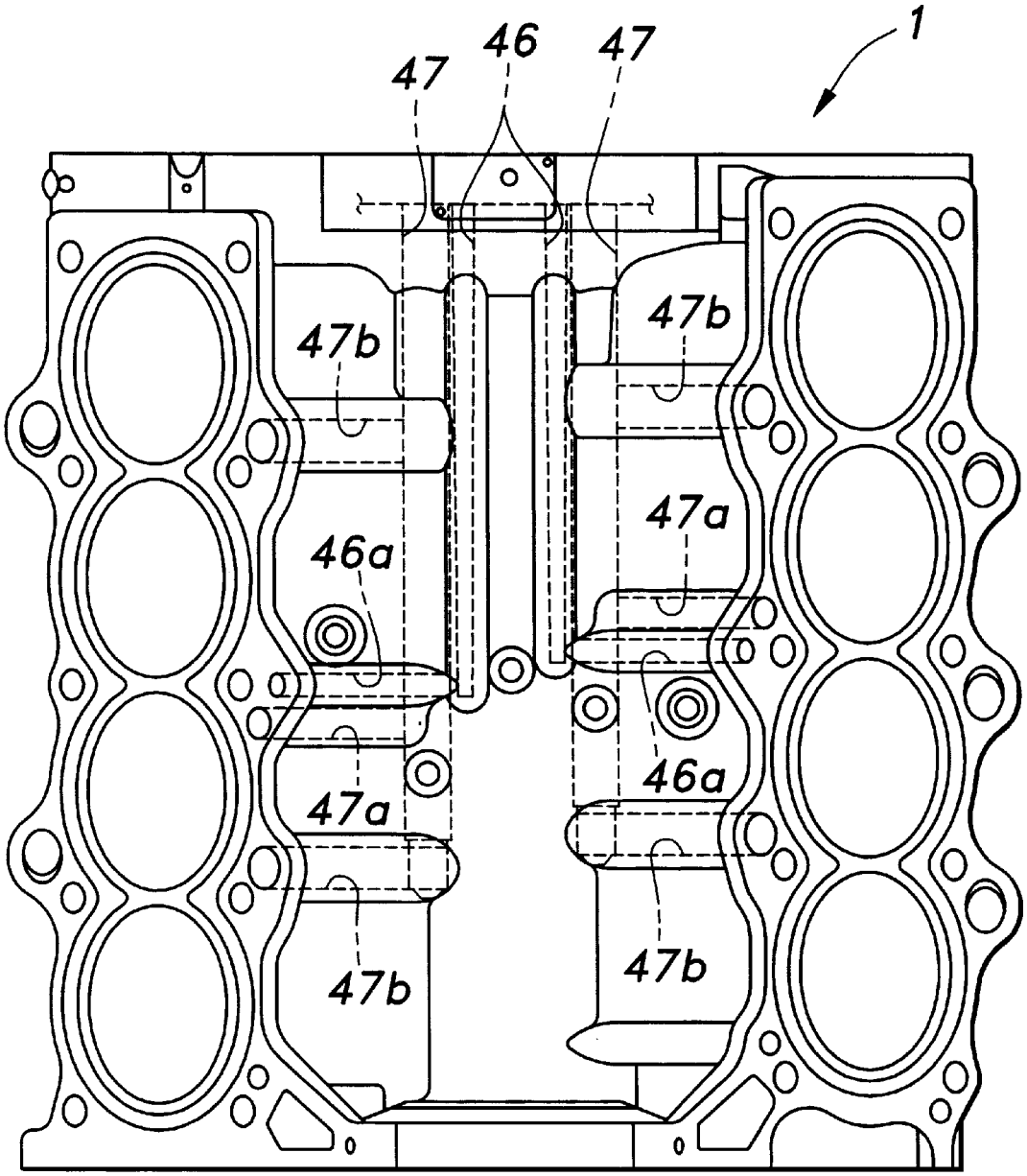
FIG. 13 is a plan view of the cylinder block of the engine shown in FIG. 1.

The blowby gas from the blowby gas chamber 25 is divided between the intake systems of the two cylinder banks B, and ultimately flows into the common fresh air chamber 26 via the respective intake systems of the two cylinder banks B. As shown in FIG. 13, the fresh air passage 47 formed in the bottom of the valley between the two cylinder banks B in the upper block 1 along the crankshaft axial line also communicates with each cam actuator chamber (not shown in the drawings) via a passage 47*b* extending along the cylinder axial line. Thereby, the oil in the cam actuator chamber is prevented from being degraded by contact with the blowby gas through ventilation of the interior of the cam actuator chamber.

As discussed above, according to a certain aspect of the present invention, a relatively large blowby gas passage and a fresh air passage can be provided without increasing the size of the engine or complicating the structure thereof. In particular, by providing these passages independently from each other, the ventilation efficiency can be improved. According to another aspect of the present invention, by elimination of the need for a connecting member such as a rubber hose, a significant contribution is made in reducing the number of component parts and the amount of assembly work. Also, because the passage length can be reduced, the efficiency of ventilation can be effectively improved. According to another aspect of the present invention, the intake manifold can be placed immediately adjacent to the upper block, and this contributes to the compact design of the engine.

Although the present invention has been described in terms of a preferred embodiment thereof, it is obvious to a person skilled in the art that various alterations and modifications are possible without departing from the scope of the present invention which is set forth in the appended claims. For instance, the blowby gas passage and the fresh air passage were defined in the interface between the cylinder block lower case and the oil pan upper member, but it is also possible to form one or both of them between the interface between the cylinder block upper and lower cases. The necessary modification for such an embodiment is obvious for a person skilled in the art by referring to the foregoing description of the preferred embodiment.

What is claimed is:

1. An engine crankcase ventilation system for an internal combustion engine including a plurality of crankcase members jointly defining a crankcase assembly, comprising:

a blowby gas passage and a fresh air passage which are defined between adjoining crankcase members indecently from each other, wherein said blowby gas passage is provided with a middle part which is enlarged as compared with an inlet end thereof so as to define an expansion chamber.

2. An engine crankcase ventilation system according to claim 1, wherein said blowby gas passage extends in parallel with a crankshaft axial line along a first side of a lower part of said crankcase assembly; and said fresh air passage extends in parallel with a crankshaft axial line along a second side of a lower part of said crankcase assembly.

3. An engine crankcase ventilation system according to claim 1, wherein said blowby gas passage is provided with baffle plates so as to define a tortuous passage.

4. An engine crankcase ventilation system according to claim 2, wherein said blowby gas passage is defined by a cylinder block lower case and an oil pan upper member, and communicates with a space above oil received in an oil pan via an opening provided in an axial end of said blowby gas passage.

5. An engine crankcase ventilation system according to claim 4, wherein said opening in the axial end of said blowby gas passage is provided in a recess in an axial end of said crankcase assembly, and an opening communicating with said space above the oil is provided also within said recess, a communication passage being defined between these two openings by a cover plate placed over said recess.

6. An engine crankcase ventilation system according to claim 4, wherein said blowby gas passage communicates with downstream of a throttle valve via an exit end of said blowby gas passage defined by an opening formed in a recess provided in an opposite axial end of said crankcase assembly, and a communication passage defined between said recess and a cover plate placed over said recess.

7. An engine crankcase ventilation system according to claim 6, wherein said internal combustion engine consists of a multiple-cylinder V-engine, and an intake system is placed between two cylinder banks of said V-engine, said communication passage communicating with the downstream of said throttle body via a first passage defined in an upper middle part of the crankcase assembly in parallel with the crankshaft axial line, and a second passage defined along a side of the cylinder bank and extending perpendicularly from a middle part of said first passage along a cylinder axial line.

8. An engine crankcase ventilation system according to claim 7, wherein said second passage communicates with the downstream of said throttle body via a passage defined in a cylinder head, and a passage defined in said intake system, and said cylinder head passage and said intake system passage communicate with each other via opposing openings in mating surfaces of said cylinder head and said intake system.

9. An engine crankcase ventilation system according to claim 7, wherein said second passage is defined in a ridge formed in a corresponding part of said cylinder bank, and said intake system is provided with a recess for receiving said ridge.

10. An engine crankcase ventilation system according to claim 2, wherein said fresh air passage is defined by a cylinder block lower case and an oil pan upper member, and communicates with a space above oil received in an oil pan via an opening provided in an axial end of said fresh air gas passage.

11. An engine crankcase ventilation system according to claim 10, said opening in the axial end of said fresh air passage is provided in a recess in an axial end of said crankcase assembly, and an opening communicating with said space above the oil is provided also within said recess, a communication passage being defined between these two openings by a cover plate placed over said recess.

12. An engine crankcase ventilation system according to claim 11, wherein said fresh air passage communicates with upstream of a throttle valve via an inlet end of said fresh air passage defined by an opening formed in a recess provided in the opposite axial end of said crankcase assembly, and a communication passage defined between said recess and a cover plate placed over said recess.

13. An engine crankcase ventilation system according to claim 12, wherein said internal combustion engine consists of a multiple-cylinder V-engine, and an intake system is placed between two cylinder banks of said V-engine, said communication passage communicating with the upstream of said throttle body via a first passage defined in an upper middle part of the crankcase assembly in parallel with the crankshaft axial line, and a second passage defined along a side of the cylinder bank and ex tending perpendicularly from a middle part of said first passage along a cylinder axial line.

14. An engine crankcase ventilation system according to claim 13, wherein said second passage communicates with the upstream of said throttle body via a passage defined in a cylinder head, and a passage defined in said intake system, and said cylinder head passage and said intake system passage communicate with each other via opposing openings in mating surfaces of said cylinder head and said intake system.

15. An engine crankcase ventilation system according to claim 14, wherein said second passage is defined in a ridge formed in a corresponding part of said cylinder bank, and said intake system is provided with a recess for receiving said ridge.

16. An engine crankcase ventilation system according to claim 14, wherein said first passage for fresh air communicates with a cam chamber defined above said cylinder head via a third passage defined along a side of the cylinder bank and extending perpendicularly from said first passage along a cylinder axial line.

17. An engine crankcase ventilation system for an internal combustion engine including a plurality of crankcase members jointly defining a crankcase assembly, a cylinder head attached to an upper part of the crankcase assembly defining a cylinder, and an intake system attached to an upper part of said cylinder head; comprising:

a blowby gas passage defined between adjoining crankcase members; and passages defined in said cylinder head and said intake system for communicating said blowby gas passage to downstream of a throttle valve;

said cylinder head passage and said intake system passage communicating with each other via opposing openings in mating surfaces of said cylinder head and said intake system;

wherein said internal combustion engine consists of a multiple-cylinder V-engine, and said intake system is placed between two cylinder banks of said V-engine, said blowby gas passage being communicated with said cylinder head passage via a communication passage defined in a ridge formed in a corresponding part of said cylinder bank, and said intake system is provided with a recess for receiving said ridge.

18. An engine crankcase ventilation system for a multiple-cylinder V-engine, including a blowby gas chamber and a fresh air chamber communicating with a crankcase independently from each other, further comprising:

a blowby gas passage and a fresh air passage communicating with said blowby gas chamber and said fresh air chamber, respectively, and extending along a crankshaft axial line between bases of two cylinder banks of said V-engine.

19. An engine crankcase ventilation system according to claim 18, wherein said fresh air passage comprises a pair of parallel passages extending on either side of a central line between the two cylinder banks, and said blowby gas passage comprises a pair of parallel passages each extending between the central line and a corresponding one of said fresh air parallel passages, said fresh air passages and blowby gas passages comprising at least one branch passage extending along a cylinder axial line.

20. An engine crankcase ventilation system for an internal combustion engine including a plurality of crankcase members jointly defining a crankcase assembly, comprising:

a blowby gas passage extending in parallel with a crankshaft axial line along a first side of a lower part of said crankcase assembly; and a fresh air passage extending in parallel with a crankshaft axial line along a second side of a lower part of said crankcase assembly;

said blowby gas passage and fresh air passage being defined between adjoining crankcase members independently from each other, and extending from an axial end of said crankcase assembly to another end.

21. An engine crankcase ventilation system according to claim 20, wherein said blowby gas passage is defined by a cylinder block lower case and an oil pan upper member, and communicates with a space above oil received in an oil pan via an opening provided in an axial end of said blowby gas passage.

22. An engine crankcase ventilation system according to claim 21, wherein said blowby gas passage communicates with downstream of a throttle valve via an exit end of said blowby gas passage defined by an opening formed in a recess provided in an opposite axial end of said crankcase assembly, and a communication passage defined between said recess and a cover plate placed over said recess.

23. An engine crankcase ventilation system according to claim 20, wherein said fresh air passage is defined by a cylinder block lower case and an oil pan upper member, and communicates with a space above oil received in an oil pan via an opening provided in an axial end of said fresh air gas passage.

* * * * *